US007326003B2

(12) United States Patent
Gagliano

(10) Patent No.: US 7,326,003 B2
(45) Date of Patent: Feb. 5, 2008

(54) SURFACE STRUCTURES AND METHODS THEREOF

(76) Inventor: Richard J. Gagliano, 8607 58th Ave., NW., Gig Harbor, WA (US) 98332

( * ) Notice: Subject to any disclaimer, the term of this patent is extended or adjusted under 35 U.S.C. 154(b) by 0 days.

(21) Appl. No.: 11/149,047

(22) Filed: Jun. 8, 2005

(65) Prior Publication Data

US 2005/0238441 A1 Oct. 27, 2005

Related U.S. Application Data

(63) Continuation-in-part of application No. 10/633,155, filed on Jul. 31, 2003, now Pat. No. 6,910,832.

(51) Int. Cl.
*E02D 27/32* (2006.01)

(52) U.S. Cl. ..... 405/229

(58) Field of Classification Search ..... 405/229
See application file for complete search history.

(56) References Cited

U.S. PATENT DOCUMENTS 4,918,891 A * 4/1990 Gerszewski ..... 52/295
5,039,256 A * 8/1991 Gagliano ..... 405/244

FOREIGN PATENT DOCUMENTS

| | | | |
|---|---|---|---|
| FR | 2560621 | * | 9/1985 |
| ZA | 990040 | * | 5/1999 |
| ZA | 2003/0231 | * | 1/2003 |

* cited by examiner

*Primary Examiner*—Sunil Singh
(74) *Attorney, Agent, or Firm*—Morgan, Lewis & Bockius LLP; Steven D. Underwood, Esq.

(57) ABSTRACT

A novel foundation system, method of manufacture and method of implementation are disclosed, comprising a simplified cast structure/pile combination advantageously shaped for selective positioning in different soil conditions to become a supporting foundation. In at least one aspect, the shape comprises a cavity or shaped recess that is initially empty, and operable to accept soil displaced by soil heave. The cavity preferably is configured to have a depth estimated to be equal to or greater that an estimated vertical heave displacement of a given site soil, in order to minimize soil heave displacement of the cast structure/pile combination. In at least one other aspect, the shape comprises a portion configured to cleave soil if the soil heaves.

8 Claims, 4 Drawing Sheets

SURFACE STRUCTURES AND METHODS THEREOF

This application is a continuation-in-part of application Ser. No. 10/633,155, filed Jul. 31, 2003 now U.S. Pat. No. 6,910,832.

FIELD OF THE INVENTION

The present invention generally relates to systems for the support of surface structures. More specifically the present invention relates to improvements to hybrid foundation systems comprised of piles and engaging cementious components, and to the methods and processes for preparing them.

BACKGROUND OF THE INVENTION

The construction of surface structures based on the rising concern for sustainable use of materials and developable lands leads in many cases to the use of minimal ground impact foundation technologies. These technologies reduce the effects of excavation and site manipulation, thereby limiting environmental impacts to surface and subsurface water flows, and soil biological functions. They also reduce erosion by curbing the volume of excavated materials, and can in many cases provide similar structural function with less material than traditional foundation solutions.

In developing these technologies for widespread use, and therefore the greatest overall environmental benefit, cost reductions are imperative. These costs can be reduced through the development of alternate component parts, or the development of more efficient means of production.

The present invention is a result of these development efforts.

Disclosure of U.S. Pat. No. 5,039,256 and 6,578,333 are hereby incorporated for reference. Please also refer to U.S. Pat. No. 7,076,925, incorporated herein by reference.

OBJECTS AND SUMMARY OF THE PRESENT INVENTION

An object of this invention is to provide an improved foundation that is applicable to a wide variety of site and soil conditions, architectural typologies, loading conditions.

A further object of this invention is to provide an improved foundation that is installed with less excavation than conventional foundation systems.

An object of this invention is to provide an improved foundation that preserves the inherent structural integrity, moisture content, and biological life of its engaged soil.

An object of this invention is to provide an improved foundation that can be used as a standardized construction component.

An object of this invention is to provide an improved foundation that has some replaceable and maintainable parts.

An object of this invention is to provide an improved foundation that can withstand frost and expanding soil conditions without jeopardizing structural function.

An object of this invention is to provide an improved foundation that requires substantially less resources than current methods require.

An object of this invention is to provide an improved process for preparing a cementious structural foundation body through which piles are driven, but without the use of embedded sleeves or selectively re-enforcing elements.

The above and other objects of the present invention are realized in a novel foundation system and method based on selectively constructed diamond piers. A novel casting method is employed to create the piers, using tapered inserts and a bifurcated mold with selectively arranged openings, mounts and the like. The casting uses a cementious material with re-enforcing elements dispersed evenly therewith. The resulting cast pier is advantageously shaped for selective positioning in many different soil conditions to become a supporting foundation.

The forgoing features of the present invention are more fully described in the following detailed discussion of the specific illustrated embodiments, and in conjunction with the accompanying drawings.

BRIEF DESCRIPTION OF THE FIGURES

For a more complete understanding of the specific embodiments, FIGS. 1-6 are provided as illustrations relating to the practice of the present invention, wherein:

FIG. 1 is a section view of the primary components used in the inventive process to create the first embodiment, including a tapered dowel and a top and bottom casting form with specific features;

FIG. 2 is a side view of the components of FIG. 1 assembled with secondary components in preparation for the creation of the first embodiment;

FIG. 3 is a perspective view of the first embodiment depicting the resulting structural body created by the components in FIG. 1, and having a cut away section which reveals the specific features;

FIG. 4 is a section view of a modified version of the primary components of FIG. 1 used now in the inventive process to create a second embodiment;

FIG. 5 is a side view of the two structural bodies the two embodiments installed in a given soil with driven piles, and including a diagram of the reactions and forces at work in the soil in relation to the shape of the bases of the embodiments and the anchoring action of the piles; and FIG. 6 illustrates the diameters sequence and relationships necessary for the proper application of the inventive process.

DETAILED DESCRIPTION OF THE INVENTION

The present invention is an improved structural component for use in hybridized cementious head and driven pile foundation systems whereby (sleeveless) cavities for receiving driven battered piles are created within a cast structural body, shaped at its base in a pyramidal or wedge configuration to facilitate its structural integration with the surrounding soil. The cavities are created through an inventive process involving the use of a tapered dowel component and specifically shaped openings in a casting form, dimensioned and prepared for the insertion and removal of these dowels and the subsequent curing of an appropriately configured cavity and adequately re-enforced surrounding structural body. The process avoids the inclusion of sleeves or independent retaining support structures, in part, by using a cementious material with dispersed steel re-enforcing fibers. These fibers enhance the tensile strength of the resulting pier, vastly simplifying the design.

In the following discussion, like numerals are used to indicate common elements depicted in various views.

First Embodiment

Figure 1:
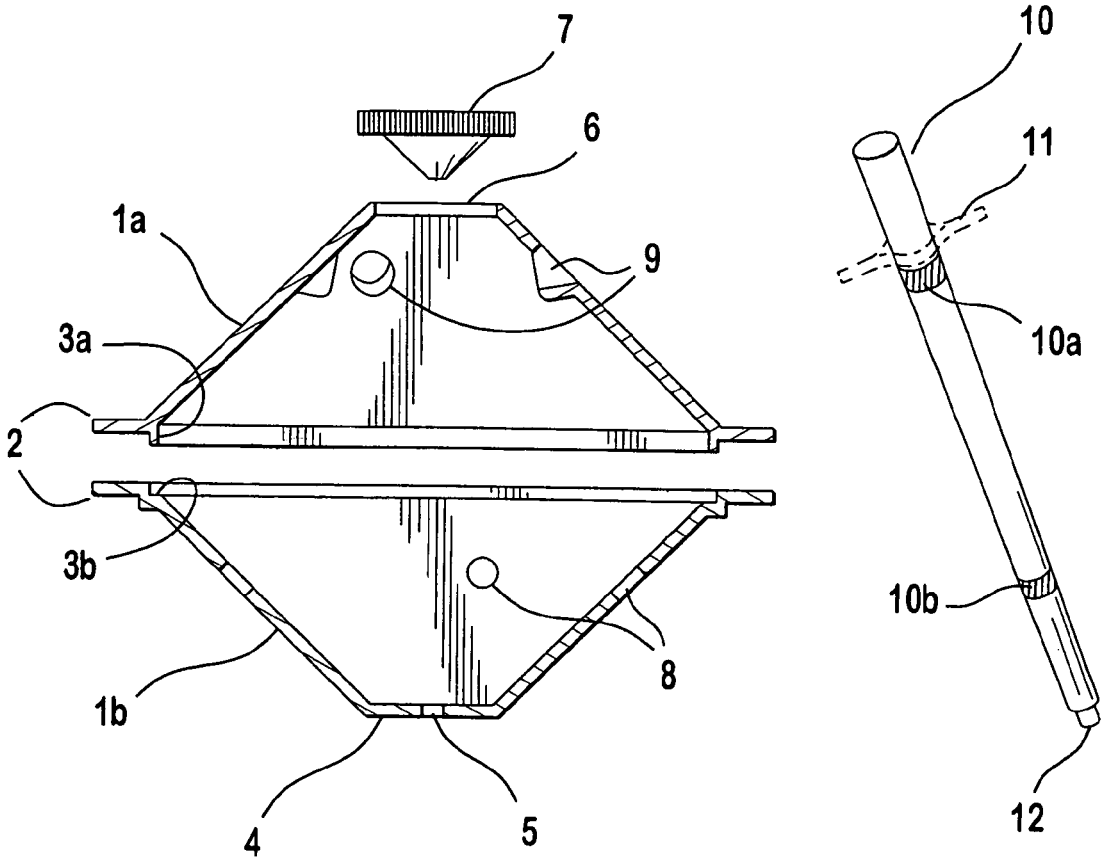

Referring now to FIG. 1, views of the primary components used in the inventive process to create the first embodiment are shown. There is a section view of a two part thermoplastic form 1*a*. and 1*b*., with side flanges 2 including a flange male and female interlock 3*a* and 3*b*. The form 1*b*. has a square shaped top 4, though this could be of any desired geometry, circular, rectangular, triangular, with a centered hole 5 for the placement of an embedded anchor bolt (see component 14, FIGS. 2 and 3). The form 1*a*. has an open end 6 for receiving a poured, curable cementious medium, and the subsequent placement of a pyramidal shaped plug 7. The use of this plug 7 will be more fully described in FIGS. 2 and 3, and in the example description. The main walls of the forms 1*a*. and 1*b*. are angled at approximately 45 degrees relative to the side flanges 2 and/or the top square plane 4. These sides contain round holes 8 in form 1*b*., and opposing, corresponding dimpled round holes 9 in form 1*a*. The tapered dowels 10 are of specific, continually reducing diameter to fit within the form holes 8 & 9. The dowels may be solid in cross section or hollow provided the wall thickness, after tapering, is sufficient for casting purposes. The upper diameter 10*a*. (shaded) corresponds with the form hole 9, and will tighten to perform a pressure fit within that hole.

As the forms age and the pressure fit is worn loose, a locking clamp 11 may be used to provide the same function whereby the tapered dowel is inserted in the form assembly through hole 9 and into and through hole 8 but will only reach to a certain depth. The lower diameter 10*b*. corresponds with the diameter of form hole 8. At the thinner end of the dowel is a tapping point 12, the function of which, along with the specific positioning of the dowel within the forms, will be described in the discussion of FIG. 2.

Figure 2:
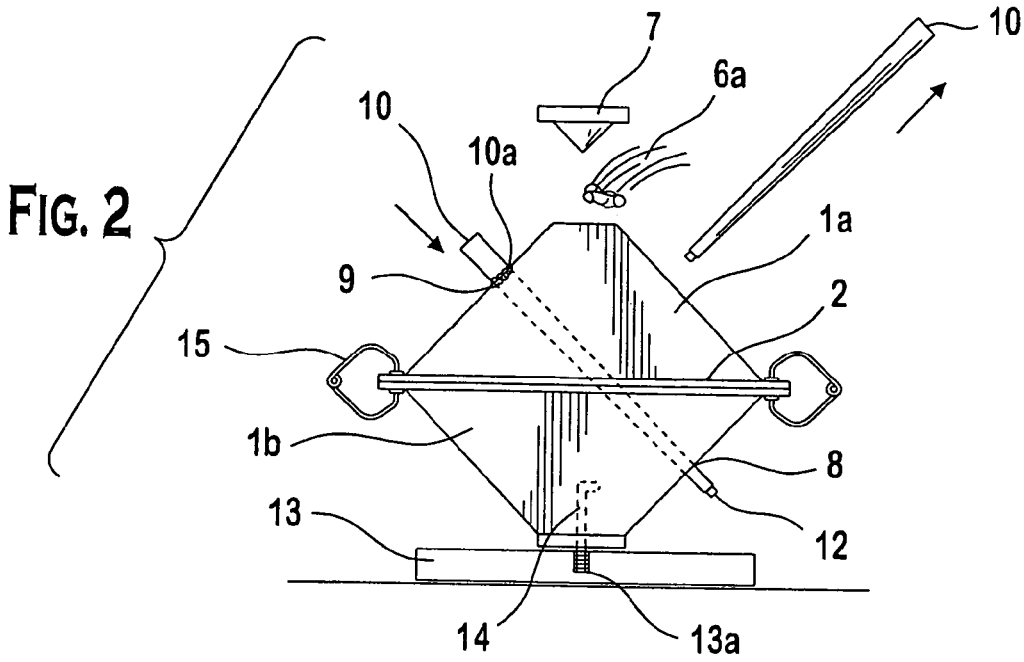

FIG. 2 is a side view of the components of FIG. 1 assembled in preparation for the casting of the first embodiment. In the inventive process, form 1*b* is attached by any ordinary mechanical means to a casting base 13. This base may be of wood, steel, plastic or any suitable material to provide a firm platform for the placement of the forms on a casting table or work surface. The casting base has a hole 13*a*. drilled a partial distance into the base specific to the desired final protrusion height of an anchor bolt 14. (This bolt function will become obvious in the discussion of FIG. 3.) Forms 1*a* and 1*b* are now clamped together along the side flanges 2 in any number of appropriate spots necessary to keep the forms interlocked throughout the pouring and curing process, and by any standard mechanical clamping device 15 known in general industry.

The tapered dowel 10 is then inserted through the dimple hole 9 and with its lower end through the round hole 8. The pressure fitting of the larger diameter section of the dowel 10*a*. restricts the extent to which the dowel protrudes from hole 8. This establishes a sufficient distance, measured from the tapping point 12 of the dowel to the casting base below, to allow the free swing of a hammer or other tapping tool to strike the point and deliver an axial impact force to the dowel. The tapping point may be marred and deformed over time by repeated strikes, therefore its diameter is substantially less than that of the thinnest end of the dowel. In this fashion, deformities of the tapping point will not restrict the removal of the dowel through the cured cavity it will subsequently create.

Once the tapered dowels have been inserted (at least 2) into the form assembly, the next step involves the pouring of a cementious, curable matrix 6*a* into the forms from above, through the top hole 6. The matrix is made up of an appropriate curable medium, and in contrast to previous art or traditional pours of cementious structural bodies, no specifically configured reinforcing rod or pre-placed tensioning element is employed. The strength and mix of this medium will be more fully described in FIG. 3. Once poured, the plugging element 7 is placed into the receiving hole 6, and the cast body is allowed to begin its curing process. At this point the casting base may be shaken or vibrated to ensure uniform flow of the cementious medium, and additional matrix may be added through the top if necessary, and re-plugged.

The dowels will be removed during the curing process, (recognizing that for some cement, curing extends long after form extraction) but before the forms are removed from the cast body. The forms are removed after the concrete has "set," i.e., that it can survive intact form removal. The taper of the dowels facilitates this removal as they will be extracted up and out of the forms such that the moving dowel will slide a continuously thinner diameter through the partially cured or cured cavity it has created. To facilitate its removal, the dowel may be rotated about its longitudinal axis to break any chemical bonds that may begin to form during the curing process of the medium. This rotating step may be done once or repeated several times as the variability in the setting chemistry unfolds. Assuming a set time of twenty-four hours, rotation should be performed every two hours, for the first eight hours. It may also not be necessary at all to rotate the dowel, and the it may be extracted cleanly with the simple tap on the tapping point to break any chemical bonds, and the dowel removed with a subsequent upward sliding extraction motion just prior to form removal. This rotation and extraction process can be done by hand or by mechanical or robotic means.

Once fully cured, with the dowels extracted, the forms are unclamped, the plug removed and the upper form 1*a*. is lifted off the cast body. The casting base and form 1*b*. assembly is then rolled to one side and the cast structural body pulled or gravity dropped from the form. The forms and components may then be cleaned and re-assembled for a subsequent casting. The resulting structural component is shown in FIG. 3.

Figure 3:
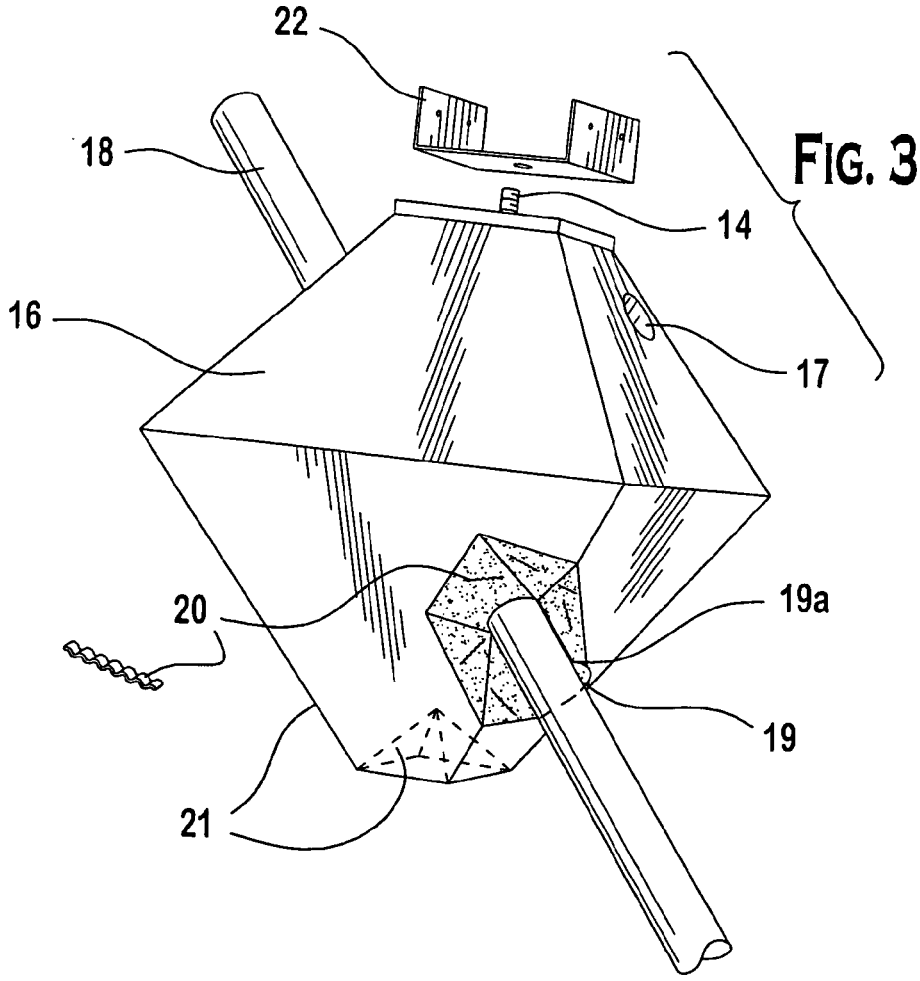

FIG. 3 is a perspective view of the cast structural body 16 now rotated to its application orientation with the anchor bolt 14 on top, and revealing a cut away section of one of the cast cavities 17 created by the tapered dowel. Theses cavities will receive driven piles 18. These piles have a continuous constant diameter, smaller than the most restrictive cross-section of the tapered cavity at its lowest end. You can see at this lower end of the longitudinal cavity, the recess 19 created by the dimple hole shape in the casting form 1*a*. of FIG. 1. This recess provides protection against the breaking of the cured surface cementious material, typically referred to as a surface spall, under the loading action of the pile.

Under load, a vertical force would be applied downward on the structural body, forcing the pile, which is embedded in surrounding earth, up against the upper edge of the lower end of the cavity. This load would typically cause a surface spall since the interlocking nature of the cementious medium cannot restrain this exposed section of the body from separating and lifting away. If such a spall occurs, it leads to further spalling since a new surface has been exposed, which, similarly, cannot resist the strain of the pile.

By creating the recess 19, the upward force of the pile is applied at a point 19*a*, at a distance sufficiently setback from the surface, and thereby contained by enough surrounding medium, to resist breaking within the loading parameters of the specific structural body. As applied, this dimpling technique may be increased and varied by increasing its depth within the cast body, depending on the scale of loads anticipated and the relative interlocking strength of the curable matrix employed.

The matrix depicted herein shows a multitude of corrugated steel fibers 20 within the binding medium. Unlike the use of these fibers in other traditional cementious applications in industry, where they are employed as secondary re-enforcing, these fibers comprise the primary re-enforcing elements within the structural body. This fact is integral with the inventive process described in the discussion of FIG. 2, since the use of these fibers directly within the matrix eliminates the costly and time consuming step of forming and placing specifically shaped re-enforcing rod components within the casting forms, and allows for easier placement, rotation and extraction of the cavity creating tapered dowels.

These fibers, through their corrugated shape and inherent tensile characteristics, significantly enhance the interlocking strength of the cured cementious medium. The proportion of fibers to matrix volume can be varied, and, as with the recessed dimple 19, may be adjusted to the loading requirements and mix medium anticipated. A suitable matrix composition includes corrugated steel fibers, one inch in length having a one-tenth inch width, 20 mils (0.020 inches) thick, and height of corrugation around 50 mils (0.050 inches). dispersed in the concrete at a ratio of one pound fiber to fifty pounds of concrete. This results, on a volumetric basis, in three pounds of steel fiber in one cubic foot of concrete. Per se, well-known industry standard mixtures of portland cement, water and stone are adequate for this application.

FIG. 3 also reveals the shape 21 of the base of the structural body created by the plug shown in FIG. 2. This angle shape, is similar in angular degree and function to the main sides of the cast body, which relate specifically as perpendicular planes the angle of the dowels and subsequent driven piles. The pitch of the angle may be varied and may take single or multiple forms, creating, but not limited to, conical, pyramidal or wedge shapes. Its function will be more fully defined in the discussion of FIG. 5.

FIG. 3 also depicts a conventional bracket attachment 22, which is bolted to the cast anchor bolt 14. This anchor bolt provides a flexible means of structural load transfer between the structural body and attached bracket.

Second Embodiment

Figure 4:
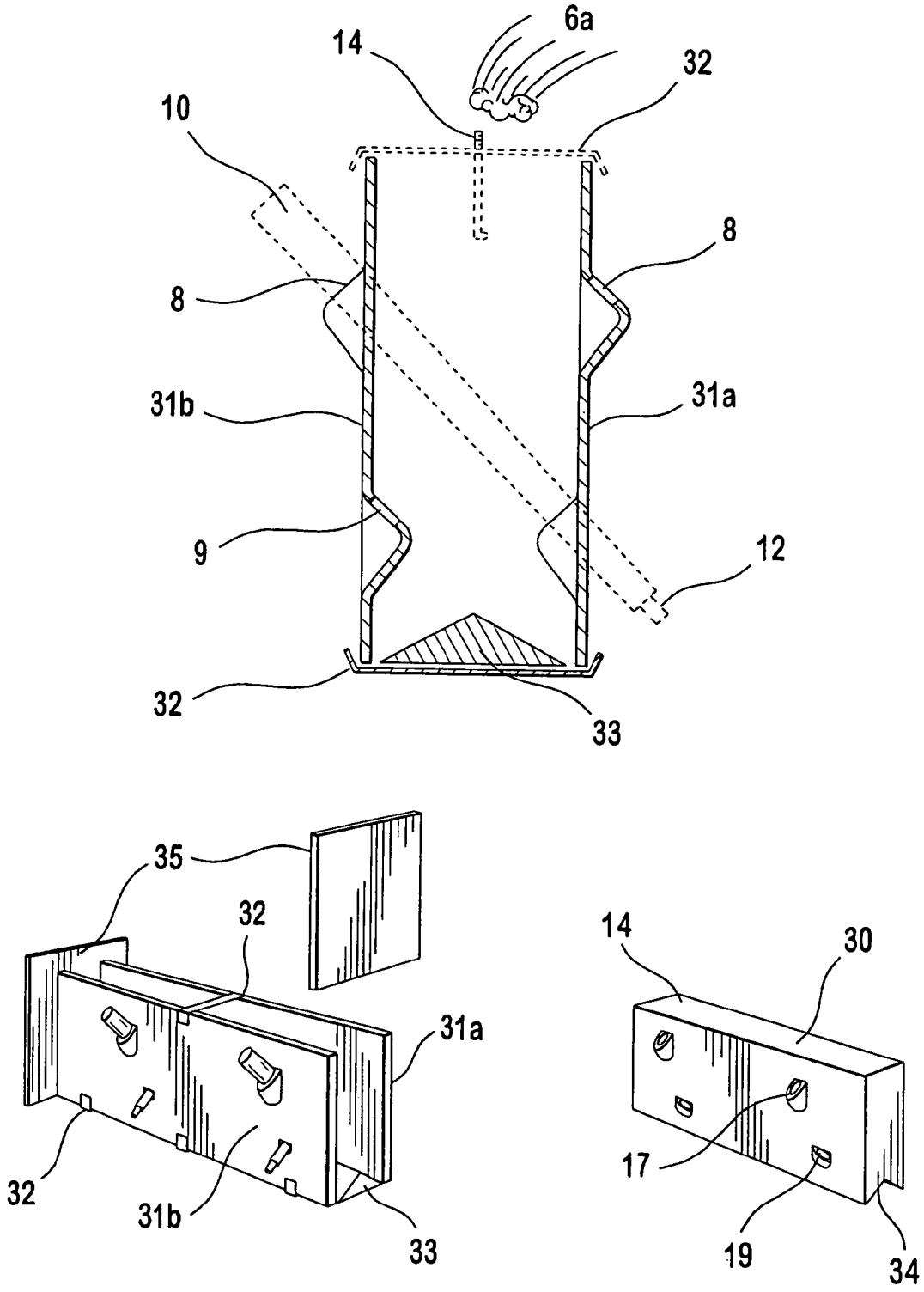

FIG. 4 is a variation on the first embodiment, creating a more rectilinear shaped structural body 30, which may be cast as a block to support point loads as in the first embodiment, but is more naturally employed as a continuous or longitudinal section of fixed width and utilizing a series of paired cast cavities along its length. In this application, rather than a top and bottom form, side forms 31*a* and 31*b* are employed. They are connected at the top and base by a restricting element 32 preventing the lateral outward movement of the forms under internal side pressures from the cementious pour. These restricting cleats are common in industry and do not represent an inventive step. The wedge block 33 is employed similar to the plug element 7 in FIG. 2. It is continuous along the full length of the forms, and will generate the necessary base shape 34 in the final cast body. The forms have round holes 8 in a section of the form shaped to be perpendicular to the axis of the dowel, and dimpled holes 9.

These forms may be made of any suitable structurally stiff material which can withstand the internal forces of the curing cementious material, and be re-used for repeatable castings. Again a tapered dowel 10 is used, complete with the necessary tapping point, and appropriate diameters corresponding to the form holes.

In casting the rectilinear structural body 30, the assembled forms, dowels and wedge block must be "book-ended" with rigid panels 35 which will restrict the flow of the cementious material. These may be integral to the side forms, or, as depicted, simply secondary components attached by some mechanical means to the side forms or restricted from movement by weights or other means external to the panels to keep them from movement during the pour and subsequent curing. It is possible as well to form an entire self contained shape such as a square or rectangle with a series of interconnected side forms and cast not a discreet block 30, but a continuous perimeter shape such as would employed for a continuous perimeter foundation.

Figure 5:
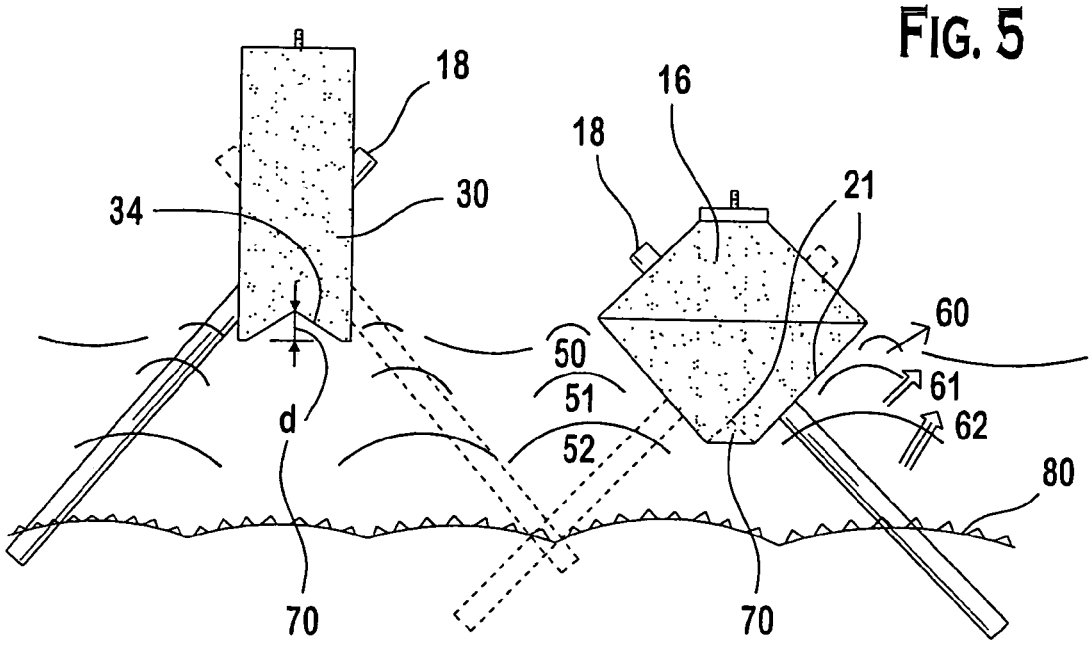

FIG. 5 shows the function of the wedge or pyramidal shape at the base of either embodiment, now installed with the application of driven piles into a surrounding soil. The installation involves clearing an appropriately sized opening for placing the pier. Piles are initially tapped slightly into the ground, positioning and orienting the pier. Using a sequential rotational process (e.g., clockwise), once oriented correctly, the piles are collectively driven into the ground slowly increasing their ground penetration until the necessary depth is achieved.

The shapes at the base of each embodiment act to cleave the soil when it heaves under frost or expansive soil conditions. In a traditional application, a foundation typically rests a flat horizontal surface against a given soil bearing area. If soils below this foundation heave, the foundation is lifted and this is undesirable as it can lead to concrete cracking, differential settlements and structural failure. In order to alleviate such a heaving soil pushing up against a conventional foundation, the horizontal flat base is typically set deeper in the soil, below what is referred to as the frost line (in the case of freeze thaw regions) or below the heaving line (in areas where silts and clay soils are subject to volumetric change to the addition (or deletion) of moisture). This step leads to the extensive excavation that causes dramatic impacts to building sites and surrounding areas.

The structural bodies 30 and 16 depicted are examples of minimal impact foundation systems which are typically installed in surface soils with little or no excavation well above region frost or heaving lines 80. The cleaving shapes 21 and 34 address the problem of heave. In the diagram the number 50 represents the first soil movement that takes place when a soil begins to heave.

In this application, the upward pushing force of the soil, (a volumetric expansion at the molecular level which translates to true volumetric change in the soil medium) first tries to lift the cast structural component. The component is of course restricted from upward movement by the anchoring action of the driven piles 18. They are still well below the heaving soil and "fight " to keep the cast component in place. But something must move since the molecular changes in the soil will not be stopped. Since there is no flat horizontal surface for the soil to push against directly, the result is that the soil spreads away from the specifically shaped cast body—it is cleaved to the side as shown in the arrow 60. As the soil heaving works its way incrementally downward (due to the nature of freezing temperatures or moisture permeating the soil) the process continues, as in heave areas 51 & 52 and the resulting sideways motions 61 & 62.

Having established this pattern of movement, the soil will continue to work in this way heaving away, but not directly against, the cast body, while the pins keep the system anchored in place. In this type of application, it is imperative that the lower ends of the driven pins are below the frost or heaving line in order to maintain anchoring resistance. Also, where the wedge configuration is internalized such as in the second embodiment 34 or the very center of the base of the first embodiment, that the depth 70 created by the plug or wedge block used in the casting process, is at least equal or greater than the estimated vertical heave displacement of a given site soil.

Figure 6:
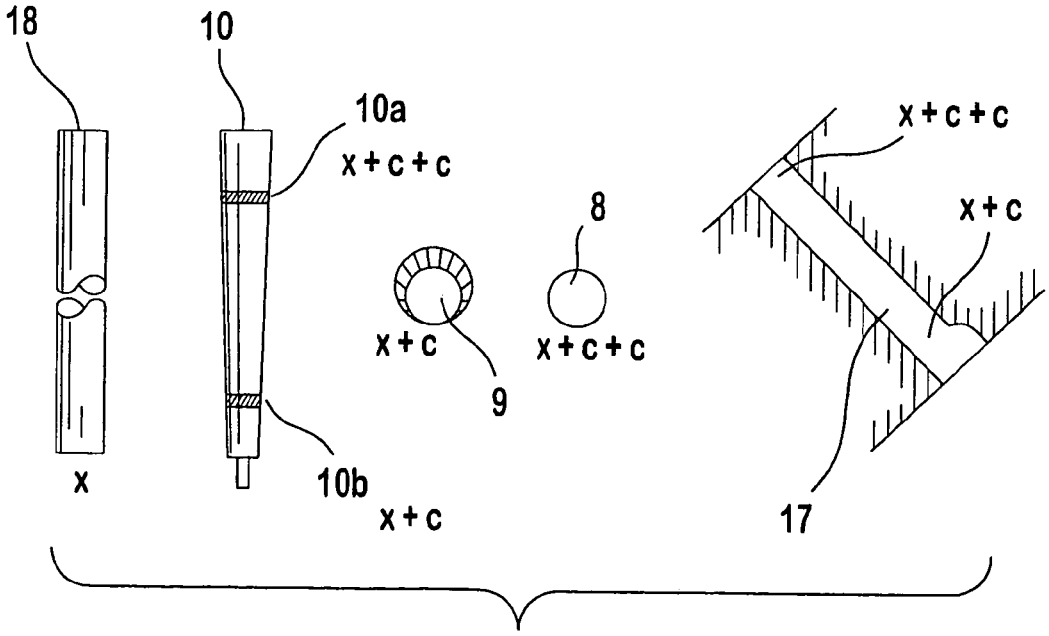

FIG. 6 again diagramatically shows the relationships between the relative diameters of the system components, where the driven piles 18 are of a constant cross section and a have a diameter x and; the tapered dowels 10 have, near the thinner end, a diameter 10*b* just larger than the pile=x+c, and at the larger end, a diameter also larger than the pile but more so =x+c+c. These diameters correspond to the round hole in a given casting form 8=x+c+c, and the dimpled hole 9=x+c. When cast to create a tapered cavity 17, the pile will be allowed a free sliding motion through the cavity without binding.

A variety of shapes containing these salient features, may be employed provided the primary components and relationships described herein are maintained.

The above description is merely illustrative of select embodiments of the present invention and does not, in any way, act to restrict the variations available to accomplish the inventive features therein. The foregoing inventions are solely limited by the appended claims on this patent.

What is claimed is:

1. A method for creating cementitious foundations resistant to soil heave, comprising the steps of:

(a) creating a form with a cavity on a lower portion, said cavity dimensioned to a volume estimated to be equal or greater to an estimated volume of soil likely to be displaced by soil heave, said form being further configured to allow one or more linearly-tapered dowel pins to be inserted through said form;

(b) inserting said one or more linearly-tapered dowel pins through said form, forming a cementitious material using said form, and removing said one or more linearly-tapered dowel pins from said formed cementitious material and said form after said cementitious material has set, each of said one or more linearly-tapered dowel pins thereby forming a tapered cavity in said formed and set cementitious material; and (c) placing said formed and set cementitious material, with said lower portion facing downward, into an excavation;

wherein said formed and set cementitious material is further placed in a manner that leaves said cavity essentially empty of soil.

2. A method as in claim 1, wherein said cavity has a triangular cross-sectional shape.

3. A method as in claim 1, wherein said cavity has a pyramidal shape.

4. A method as in claim 1, wherein said cavity has an inverted wedge shape.

5. A method as in claim 1, wherein said cavity is dimensioned to have a depth estimated to be equal to or greater that an estimated vertical heave displacement of said soil.

6. A method as in claim 1, further comprising inserting a pile into each of said tapered cavities and into said soil so as to anchor said formed and set cementitious material in the event of soil heave.

7. A method as in claim 6, wherein said piles are each inserted to a depth at or below a frost line.

8. A method as in claim 6, wherein said piles are each inserted to a depth at or below a heaving line.

* * * * *